US005253837A

United States Patent [19]

Loux

[11] Patent Number: 5,253,837

[45] Date of Patent: Oct. 19, 1993

[54] SHELF BRACKET FOR USE WITH CONDUIT

[76] Inventor: Charles W. Loux, 6858 Netherland Dr., Middletown, Ohio 45044

[21] Appl. No.: 993,403

[22] Filed: Dec. 21, 1993

[51] Int. Cl.[5] ..... A47G 29/02

[52] U.S. Cl. ..... 248/250; 108/152; 211/90

[58] Field of Search ..... 248/49, 68.1, 235, 74.1, 248/250; 211/90; 108/152

[56] References Cited

U.S. PATENT DOCUMENTS

| | | | |
|---|---|---|---|
| 275,481 | 4/1883 | Gould | 211/90 X |
| 306,335 | 10/1884 | Higley | 211/90 |
| De. 316,000 | 4/1991 | Logan et al. . | |
| 442,468 | 12/1890 | Wegener | 211/90 |
| 928,190 | 7/1909 | Flynn . | |
| 1,055,784 | 3/1913 | Ness . | |
| 2,944,863 | 7/1960 | Bertelsen | 211/90 X |
| 2,979,298 | 4/1961 | Kenyon | 248/68.1 X |
| 3,002,666 | 10/1961 | Silverman . | |
| 3,174,628 | 3/1965 | Kirch, Jr. . | |
| 3,233,852 | 2/1966 | Azar | 248/68.1 |
| 3,263,947 | 8/1966 | Kerttunen | 248/68.1 |
| 3,288,308 | 11/1966 | Gingher . | |
| 3,419,155 | 12/1968 | Black | 211/90 |
| 3,787,016 | 1/1974 | Laval | 248/49 |

*Primary Examiner*—J. Franklin Foss
*Attorney, Agent, or Firm*—Charles R. Wilson

[57] ABSTRACT

A shelf system for use primarily on home garage and basement walls is inexpensive, though very functional. The shelf system is comprised of shelf brackets and a set of elongated members. The shelf brackets have a vertical leg, a horizontal leg extending from the vertical leg and having at least three recesses formed in it, and a diagonal support leg. The recesses in the horizontal leg are dimensioned to receive elongated members such as conduits in a manner wherein the top surfaces of the elongated members extend above the horizontal leg of the shelf bracket. The conduits collectively form a shelf to hold goods.

20 Claims, 2 Drawing Sheets

FIG. 1
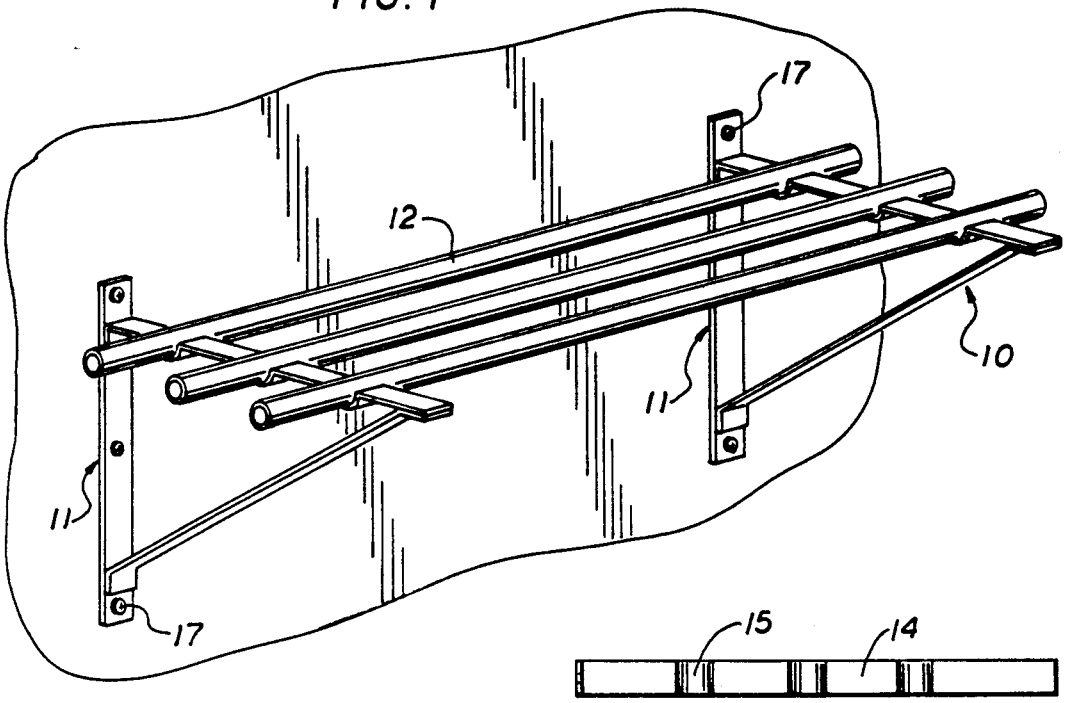
FIG. 3
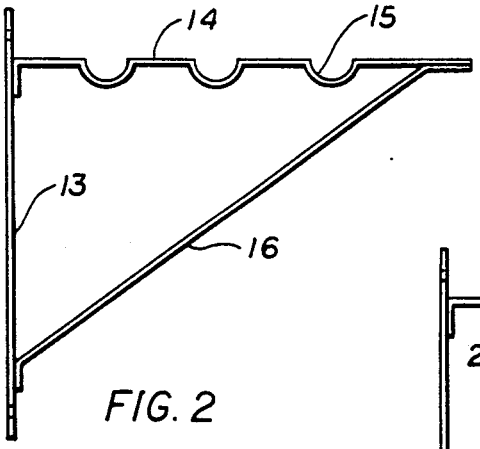
FIG. 2
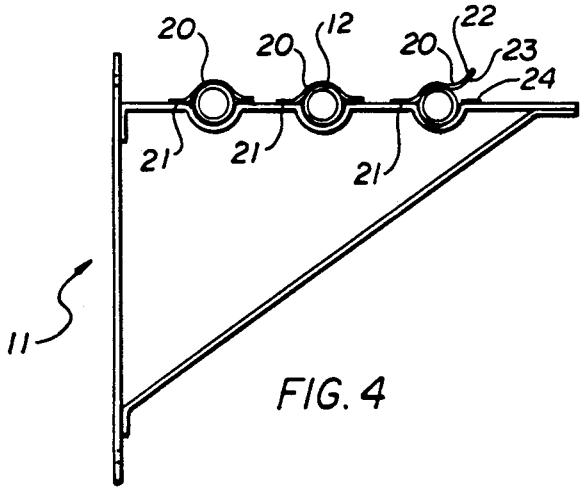
FIG. 4

SHELF BRACKET FOR USE WITH CONDUIT

This invention relates to a shelf bracket and a shelf system. More particularly, the invention relates to a shelf bracket for use with a set of elongated members to form a shelf system.

Shelves are widely used in home, office, commercial and industrial settings. Most shelf systems have a support means attached to a wall or some other vertical surface and a flat shelf which rests on the support means. The particular size of the system as well as its appearance is dictated primarily by its intended use and location of use. Home shelf systems tend to be decorative as well as functional. A shelf system for use in a home garage, basement or workshop tends to be primarily functional in nature with minimal regard for its appearance.

Cost is always a factor with virtually any shelf system. For those systems designed for use in the home, cost is less of a concern in that the homeowner views the shelf system as a long term investment which is a part of the overall appearance of the decorative scheme. However, cost seems to become of paramount importance with a shelf system used in the garage or some other out of the way part of the home. The homeowner simply does not want to expend any substantial sum of money for an item so basic and functional as a shelf. The workshop owner is also concerned with cost, but gives more consideration to ease of use and durability.

Shelf systems for use in the home garage or basement are very prevalent. The systems tend to be very basic with right angle wall brackets and a flat board attached thereto. Such systems are inexpensive, relatively easy to install and functional. They do have drawbacks, though, which are of some concern. Boards used with the brackets tend to be difficult to transport to the home unless the homeowner has access to a truck or van. The boards can be heavy and cumbersome to position on the brackets if the shelf is long. The solid nature of the board itself can hide from view items stored on the shelf, especially back towards a wall.

While conventional shelf systems for use in the home, garage and basement areas are adequate and widely accepted there is still a need for an improved shelf system. Such a system must be relatively inexpensive, easy to install and durable. Additionally, the system ideally overcomes disadvantages of known systems such as bulkiness and lack of full item viewing.

There has now been developed a shelf bracket and shelf system which is an improvement upon known technologies. The improved shelf bracket and system using the bracket is inexpensive to produce, easy to install and very functional. It serves a need experienced by many homeowners in particular, though shop owners and other commercial and industrial users will benefit.

SUMMARY OF THE INVENTION

A shelf bracket for use in a shelf system comprises a vertical leg for mounting on a wall, a horizontal leg extending from the vertical leg and having at least three recesses formed therein, an optional retaining means associated with each recess and a diagonal support leg extending from near a bottom of the vertical leg to near an end of the horizontal leg. A set of elongated members, such as rounded conduit is positioned in the recesses of the brackets to form a shelf system which is inexpensive and very functional in nature.

BRIEF DESCRIPTION OF THE DRAWINGS

FIG. 1 is an environmental view showing two shelf brackets of the invention mounted on a wall with a set of conduits in place to form a shelf system.

FIG. 2 is a side view of one of the shelf brackets of FIG. 1.

FIG. 3 is a top view of the shelf bracket of FIG. 2.

FIG. 4 is a side view of the shelf bracket of FIG. 1 with a set of conduit in place and retaining means added.

DETAILED DESCRIPTION OF THE INVENTION

Figure 5:
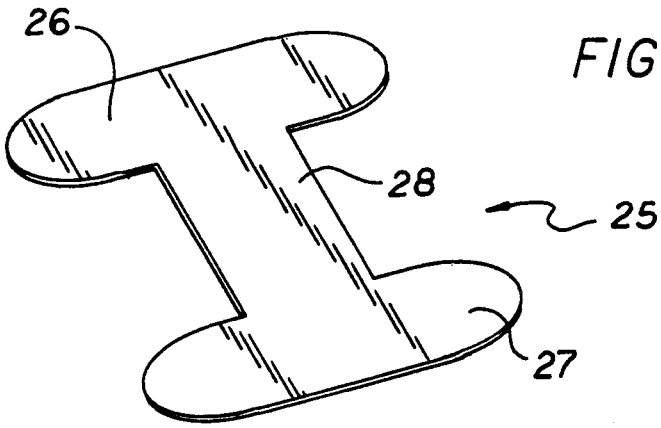
FIG. 5 is a perspective view of a preferred retaining means used with the shelf bracket of FIG. 1.

The shelf bracket and shelf system of this invention are described in detail in the following paragraphs with particular reference to the drawings. The shelf system is particularly useful in the home garage or basement and this preferred use is described. However, the shelf bracket and shelf system are useful elsewhere and such uses are contemplated.

With reference to FIG. 1 there is shown the shelf system 10 of the invention mounted on a wall. The system 10 is comprised of two shelf brackets 11 and a set of elongated members 12 properly positioned. The shelf system is mounted as a single shelf. It should be readily apparent two or even multiple columns of shelf systems can be mounted on a wall, each at a different height from the floor. The shelf system 10 is capable of being loaded with boxes, containers and items of all sorts and sizes.

The shelf bracket 11 as best seen in FIGS. 2 and 3 has a vertical leg 13, a horizontal leg 14 with three recesses 15, and a diagonal support leg 16 as its essential components. The vertical leg 13 is a rigid bar strip, generally about nine inches to about fifteen inches long, though its length can vary depending on the contemplated load for the shelf system. The heavier the load, the greater the length and gauge of the vertical leg as well as of the horizontal and diagonal support legs. At least two holes 17 are drilled through a face of the vertical leg to receive bolts or screws for wall mounting purposes.

Extending substantially perpendicularly from near the top of the vertical leg 13 is a horizontal leg 14. The horizontal leg has at least three recesses formed in it. As shown and preferred, the horizontal leg 14 has three recesses 15. The recesses are preferably substantially equi-spaced across the horizontal leg 14. Each recess is shaped according to the elongated member for use with it. As shown in FIGS. 1 and 4, the elongated members 12 are rounded conduits. Accordingly, the recesses 15 are rounded, preferably they are half-round bends to partially receive the rounded conduit in a substantially wobble-free state. The recesses are also dimensioned according to the contemplated elongated member. They are dimensioned so that a top surface of the elongated member when positioned in a recess extends above the top surface of the horizontal leg. This is needed to provide a smooth continuous resting surface for the goods throughout the length of the shelf system.

Preferably, the half-round bends 15 of the shelf brackets 11 have a radius of from about three-eighths inch to about one inch. Such a size is ideal for properly holding a conduit of from about three-fourths inch to about two inches outside diameter. Such conduits are commercially available and relatively inexpensive.

Figure 7:
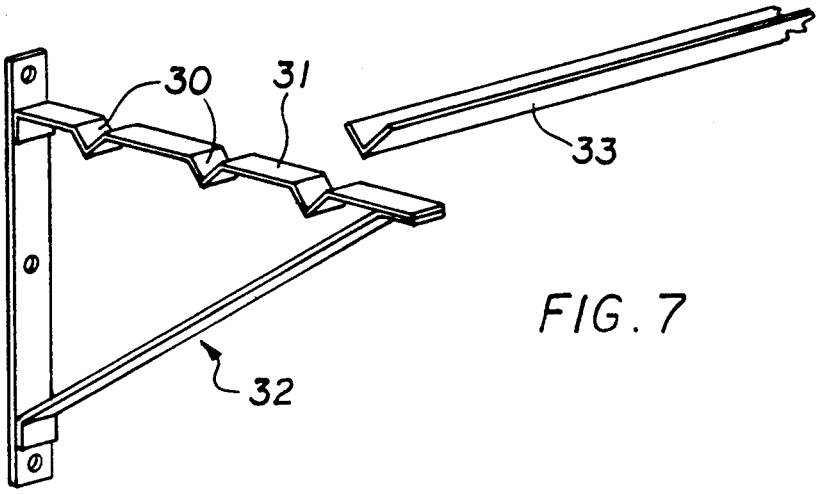
FIG. 7 is a perspective view of another shelf bracket of the invention with elongated members in position.

Other recess shapes and sizes are useful in this invention. For example, as depicted in FIG. 7, a series of V-shaped recesses 30 are formed in a horizontal leg 31 of a shelf bracket 32 to hold angle iron elongated members 33. However, the rounded conduit described above together with the half-round bends are more feasible and for this reason are highly preferred embodiments of the invention.

A diagonal support leg 16 extends from near the bottom of the vertical leg 13 to near the end of the horizontal leg 14. The support leg 16 obviously provides a strengthening force to the bracket 11 to keep the horizontal leg 14 in a horizontal plane when a load is applied to it.

Optional, though highly preferred, is the use of a set of retaining means on the horizontal leg of the shelf bracket. As best seen in FIG. 4, a flexible hold-down strap 20 is operably associated with each of the recesses 15. The purpose of the strap is to retain the elongated members 12 in position during use. As can be imagined, the elongated members are subject to being bumped or jarred out of position during use unless care is taken by the homeowner. The straps 20 lessen the chances of an elongated member being accidentally moved.

Each flexible strap 20 is a strip of material which is permanently attached at one end 21 to the horizontal leg 14 near a recess. The strap is sufficiently long to wrap over an elongated member and have its free end 22 semi-permanently attached to the horizontal leg 14 on the other side of the recess. Hook and loop fasteners are one means for achieving the semi-permanent attachment. Thus the strap 20 has a hook or loop fastener 23 on its underside and a second mating hook or loop fastener 24 is adhesively attached to the horizontal leg. The length of the straps 20 and positionings of the hook and loop fasteners are such that they match when the strap is wrapped around the elongated member and pulled tightly down to the horizontal leg of the bracket 11.

Figure 6:
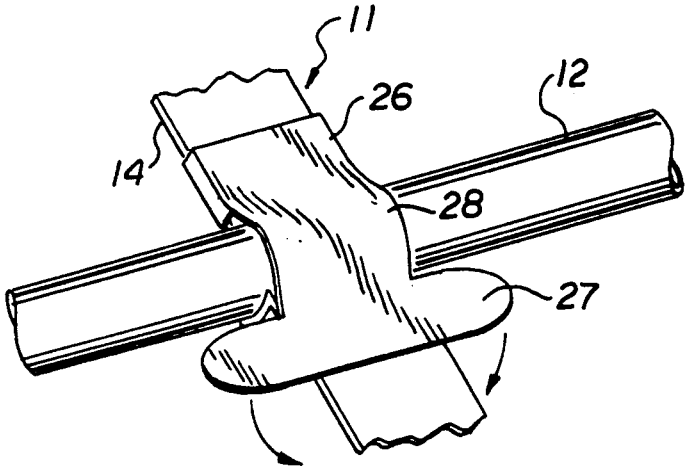
FIG. 6 is a perspective view of the retaining means of FIG. 5 positioned on the shelf bracket of FIG. 1.

Other retaining means in place of the flexible straps are possible. For example, rigid conduit straps with screw attachment means can be used for a more permanent arrangement. An especially preferred retaining means is shown in FIGS. 5 and 6. A semi-rigid H-shaped clamp 25 is used to hold the member 12 in position on the shelf bracket 11. The clamp 25 has two legs 26 and 27 with a cross-leg 28 connecting the two legs. Each leg 26 and 27 has a length sufficient to cover the width of the horizontal leg 14 of the bracket and wrap at least partially around its underside. The cross-leg 28 has a sufficient length to cover the elongated member 12. The clamp is used by placing the cross-leg over the conduit on a bracket and then bending each of the four half legs around to the underside of the bracket. This preferred retaining means is economical to produce, easy to use, and is a strong semi-permanent retaining means which holds the conduit in place.

The elongated members for use with the shelf brackets to form a shelf system are any long rigid members such as plastic or metal conduit, rods and strips having a shape which approximates that of the recess in the bracket. Metal conduit is preferred because of its relatively low cost, rigidity and ability to be readily cut to length.

The shelf system of the invention is easily mounted on a wall. At least two of the shelf brackets are mounted to a wall at substantially equal heights from the floor. A third shelf bracket or more may be needed depending on the load intended for the system. Once the brackets are mounted, a set of elongated members are cut to length and laid into the recesses of the brackets. Finally, in the preferred embodiment of the invention, the retaining means are wrapped over the elongated members and their free ends attached to the horizontal leg of the bracket. The shelf system is now ready for use.

While the invention has been described in detail with particular reference to the drawings, it should be understood that various modifications can be made to the shelf bracket and shelf system. All such obvious modifications and variations are considered within the scope of the appended claims.

I claim:

1. A shelf bracket for mounting on a wall for use in conjunction with a set of elongated members to form a shelf system, said shelf bracket having (i) a vertical leg for attachment to the wall; (ii) a horizontal leg extending substantially perpendicular from the vertical leg, said horizontal leg having at least three recesses formed in it to partially receive the elongated members in a substantially wobble-free state and dimensioned such that a top surface of each elongated member extends above the top surface of the horizontal leg; and (iii) a diagonal support leg extending from near a bottom of the vertical leg to near an end of the horizontal leg.

2. The shelf bracket of claim 1 wherein the recesses in the horizontal leg are rounded to receive rounded conduit.

3. The shelf bracket of claim 1 wherein the recesses in the horizontal leg are V-shaped to receive angle-iron.

4. The shelf bracket of claim 1 wherein there are three substantially equi-spaced half-round bends in the horizontal leg.

5. The shelf bracket of claim 4 wherein each half-round bend has a radius of from about three-eighths inch to about one inch.

6. The shelf bracket of claim 1 further comprising a retaining means operably associated with each recess to extend across the recess to retain the elongated member.

7. The shelf bracket of claim 6 wherein each retaining means is a flexible strap permanently attached at one end to the horizontal leg and means on a free end to semi-permanently attach to the horizontal leg.

8. The shelf bracket of claim 6 wherein the retaining means is a semi-rigid H-shaped clamp.

9. The shelf bracket of claim 8 wherein the H-shaped clamp has two legs connected by a cross-leg wherein each leg has a length sufficient to cover the width of a horizontal leg and wrap at least partially around its underside and the cross-leg has a length sufficient to cover the elongated member.

10. The shelf bracket of claim 5 wherein the vertical leg has at least two holes extending through it to receive attachment means for holding the shelf bracket to the wall.

11. A shelf system for attachment to a wall, said system comprising:

(a) at least two shelf brackets, each said bracket having (i) a vertical leg for attachment to the wall; (ii) a horizontal leg extending substantially perpendicular from the vertical leg, said horizontal leg having at least three recesses formed in it to partially receive the elongated embers in a substantially wobble-free state and dimensioned such that a top surface of each elongated member extends above the top surface of the horizontal leg; and (iii) a diagonal support leg extending from near a bottom of the vertical leg to near an end of the horizontal leg; and (b) a set of elongated members, each elongated member resting in one of the recesses on the horizontal leg of each shelf bracket in a manner such that a top surface of each said elongated member extends above the horizontal leg of the shelf brackets.

12. The shelf system of claim 11 wherein the recesses in the horizontal leg of the shelf brackets are rounded and the elongated members are rounded conducts.

13. The shelf system of claim 11 wherein the recesses in the horizontal leg of the shelf brackets are V-shaped and the elongated members are angle irons.

14. The shelf system of claim 12 wherein each shelf bracket has three substantially equi-spaced half-round bends in its horizontal leg.

15. The shelf system of claim 14 wherein each half-round bend in the shelf brackets has a radius of from about three-eighths inch to about one inch and each conduit has an outside diameter of from about three fourths inch to about two inches.

16. The shelf system of claim 15 having two shelf brackets and three elongated members.

17. The shelf system of claim 11 wherein each shelf bracket further comprises a retaining means operably associated with each recess in its horizontal leg to extend across the recess to retain an elongated member in position.

18. The shelf system of claim 17 wherein each retaining means is a flexible strap permanently attached at one end to the horizontal leg of the bracket with means at the free end to semi-permanently attach to said horizontal leg.

19. The shelf system of claim 17 wherein the retaining means is a semi-rigid H-shaped clamp.

20. The shelf system of claim 19 wherein the H-shaped clamp has two legs connected by a cross-leg wherein each leg has a length sufficient to cover the width of the horizontal leg of the shelf bracket and wrap at least partially around its underside and the cross-leg which has a length sufficient to cover the elongated member.

* * * * *

UNITED STATES PATENT AND TRADEMARK OFFICE

CERTIFICATE OF CORRECTION

PATENT NO. : 5,253,837

DATED : Oct. 19, 1993

INVENTOR(S) : Charles W. Loux

It is certified that error appears in the above-indentified patent and that said Letters Patent is hereby corrected as shown below:

On title page, item [22] should read --Filed: Dec. 21, 1992--

Signed and Sealed this

Third Day of May, 1994

Bruce Lehman

*Attest:*

BRUCE LEHMAN

*Attesting Officer*

*Commissioner of Patents and Trademarks*